US010875306B2

(12) United States Patent
Hayashi

(10) Patent No.: US 10,875,306 B2
(45) Date of Patent: Dec. 29, 2020

(54) LIQUID EJECTION HEAD HAVING PROTRUDING PIECES PROVIDED IN COMMON CHANNEL

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/539,704

(22) Filed: Aug. 13, 2019

(65) Prior Publication Data

US 2020/0101731 A1 Apr. 2, 2020

(30) Foreign Application Priority Data

Sep. 27, 2018 (JP) ..... 2018-182625

(51) Int. Cl.
*B41J 2/14* (2006.01)

(52) U.S. Cl.
CPC ..... *B41J 2/1433* (2013.01); *B41J 2/14201* (2013.01); *B41J 2002/14419* (2013.01)

(58) Field of Classification Search
CPC ..... B41J 2/1433; B41J 2/14201; B41J 2002/14419; B41J 2202/21; B41J 2002/14241; B41J 2/14233; B41J 2202/11; B41J 2202/12; B41J 2002/14459
See application file for complete search history.

(56) References Cited

U.S. PATENT DOCUMENTS

2010/0214380 A1 8/2010 Essen et al.
2015/0002582 A1 1/2015 McKinnell et al.

FOREIGN PATENT DOCUMENTS

JP 2012-011629 A 1/2012
JP 2012011629 A * 1/2012
JP 2015-036238 A 2/2015

OTHER PUBLICATIONS

Feb. 13, 2020—(EP) Extended Search Report—App 19191262.5.

* cited by examiner

*Primary Examiner* — Henok D Legesse
(74) *Attorney, Agent, or Firm* — Banner & Witcoff, Ltd.

(57) ABSTRACT

A liquid ejection head is connected to a storage chamber having an outlet port and an inlet port. The liquid ejection head includes a plurality of discrete passages, a common channel and a protruding piece. The plurality of discrete passages each has an inlet opening and an outlet opening. The common channel is defined by two walls facing each other. The common channel includes a common supply channel and a common return channel. The common supply channel is connected to the outlet port and to the inlet opening to introduce the liquid. The common return channel is connected to the outlet opening and to the inlet port to return the liquid. The protruding piece is provided in each of the common supply channel and the common return channel and protruding from at least one of the walls.

17 Claims, 10 Drawing Sheets

LIQUID EJECTION HEAD HAVING PROTRUDING PIECES PROVIDED IN COMMON CHANNEL

CROSS REFERENCE TO RELATED APPLICATION

This application claims priority from Japanese Patent Application No. 2018-182625 filed Sep. 27, 2018. The entire content of the priority application is incorporated herein by reference.

TECHNICAL FIELD

The present disclosure relates to a liquid ejection head having a plurality of discrete channels and a common channel in communication with the discrete channels.

BACKGROUND

Japanese Patent Application Publication No. 2015-036238 discloses a liquid ejection head having, as a common channel, a common supply channel and a common recovery or return channel, those being in communication with a plurality of discrete channels. The common supply channel and the common recovery channel extend obliquely by a predetermined angle with respect to a longitudinal direction of the head, and are arrayed with each other in the longitudinal direction.

SUMMARY

Numbers of the common channels in the head having the common supply channel and the common recovery channel for the plurality of discrete channels as disclosed in the JP publication is greater than that in a head having only the common supply channel for the plurality of discrete channels. If miniaturization of the head and high-density arrangement of the channels are contemplated in the head having the plurality of arrayed common channels, a thickness of a wall defining each common channel may be small. In such a case, deformation or crack of the wall may occur in a process of adhesion between a component forming the common channels and a complementary component during production of the head.

In view of the foregoing, it is an object of the disclosure to provide a liquid ejection head capable of restraining deformation and crack of the wall defining the common channels.

In order to attain the above and other objects, according to one aspect, the disclosure provides a liquid ejection head fluidly connected to a storage chamber storing therein a liquid. The storage chamber has an outlet port and an inlet port. The liquid ejection head includes a plurality of discrete passages, a common channel and a protruding piece. The plurality of discrete passages each has a nozzle, an inlet opening and an outlet opening. The common channel is in communication with the plurality of discrete passages. The common channel is defined by two walls extending in a first direction and facing with each other in a second direction perpendicular to the first direction. The common channel includes a common supply channel and a common return channel. The common supply channel is fluidly connected to the outlet port and to the inlet opening to introduce the liquid in the storage chamber to the plurality of discrete passages through the common supply channel. The common return channel is fluidly connected to the outlet opening and to the inlet port to return the liquid in the plurality of discrete passages to the storage chamber. The protruding piece is provided in each of the common supply channel and the common return channel and protruding from at least one of the walls.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

First Embodiment

A liquid ejection head 1 according to a first embodiment will be described with reference to FIGS. 1 through 6. Firstly, a printer 100 provided with the head 1 will be described with reference to FIG. 1.

Figure 1:
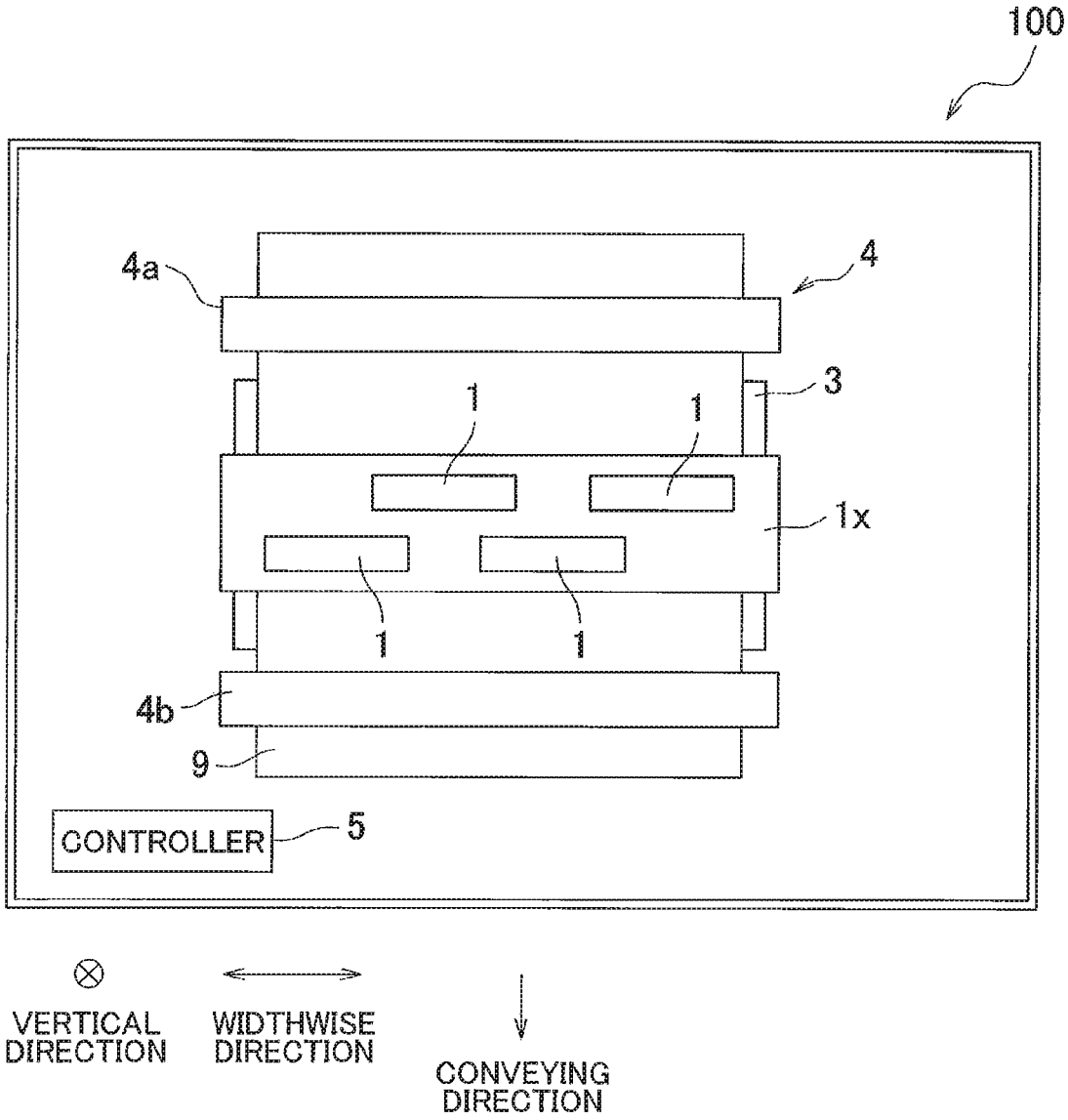
FIG. 1 is a schematic plan view of a printer 100 provided with a head 1 according to a first embodiment.

The printer 100 includes a head unit 1*x* including four heads 1, a platen 3, a conveying mechanism 4, and a controller 5. The conveying mechanism 4 includes a pair of rollers 4*a*, 4*b* and a conveyer motor (not illustrated). The rollers 4*a* and 4*b* are positioned upstream and downstream of the platen 3, respectively in a conveying direction of a sheet 9. In FIG. 1, the conveying direction is perpendicular to a vertical direction. The rollers 4*a*, 4*b* are rotatable by operation of the conveyer motor to convey the sheet 9 in the conveying direction.

The head unit 1*x* is of the type of a line printing. That is, the head unit 1*x* is immovable, and is configured to eject ink to the sheet 9 from a plurality of nozzles 33*d* (see FIGS. 2 and 3). The head unit 1*x* has an elongated rectangular shape extending in a widthwise direction of the sheet 9. The widthwise direction is perpendicular to the conveying direction and the vertical direction. The four heads 1 are arrayed with each other in a staggered fashion in the widthwise direction. Each head 1 includes a driver IC (not illustrated).

The platen 3 is a flat plate-like member, and is positioned below the head unit 1*x* and between the rollers 4*a* and 4*b* in the conveying direction. The platen 3 has an upper surface on which the sheet 9 is carried.

The controller 5 includes a ROM (read only memory), a RAM (random access memory), and an ASIC (application specific integrated circuit). The ASIC is configured to execute printing process in accordance with a program stored in the ROM. In the printing process, the controller 5 controls the driver IC of each head 1 and the conveyer motor of the conveying mechanism 4 in response to printing instruction containing image data transmitted from an external device such as PC (personal computer) to form an image on the sheet 9.

Figure 3:
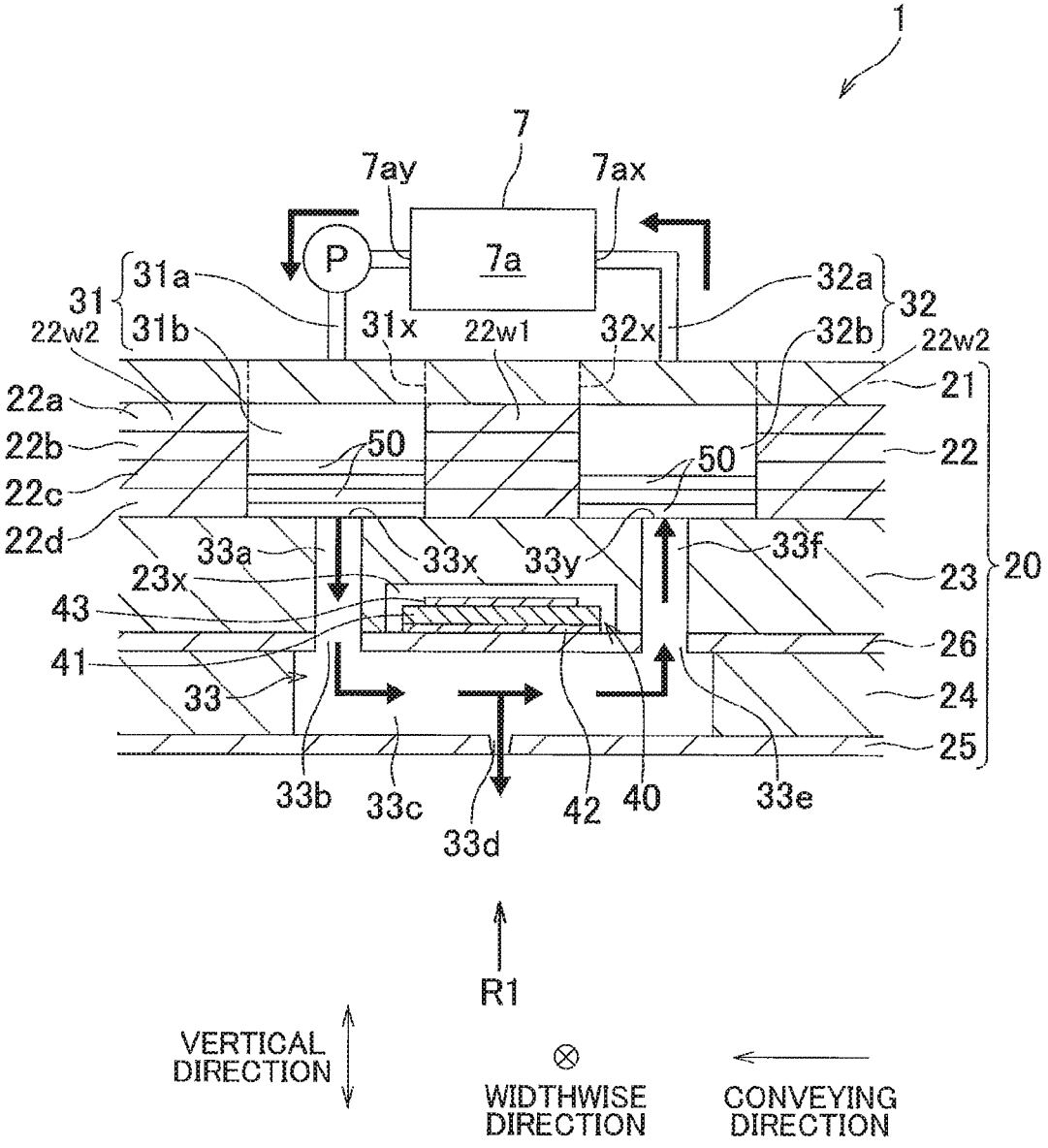
FIG. 3 is a cross-sectional view taken along a line III-III in FIG. 2.

As illustrated in FIG. 3, the head 1 includes a channel unit 20 including four plates 21, 23, 24, 25 and a plate unit 22, and four actuators 40. The four plates 21 23-25, and the plate unit 22 are laminated one after another in a vertical direction and are adhered to each other.

The plate 25 is the lowermost plate among the four plates 21 and 23-25 and the plate unit 22. The plate 25 is formed with a plurality of through-holes each constituting a nozzle 33*d*.

Figure 2:
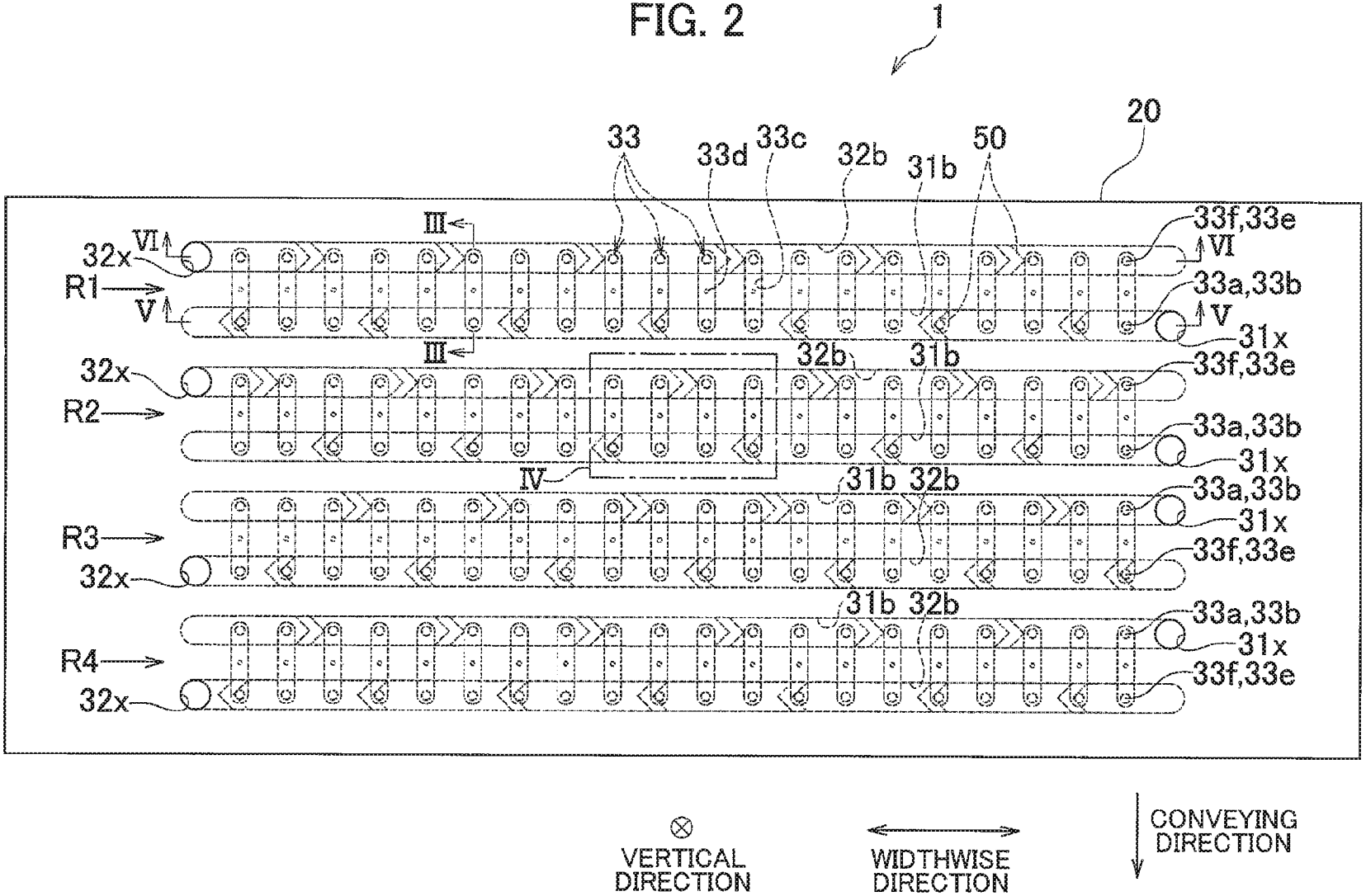
FIG. 2 is a plan view of the head 1 according to the embodiment.

The plate 24 is positioned on an upper surface of the plate 25. The plate 24 is formed with a plurality of through-holes each constituting a pressure chamber 33*c*. The pressure chamber 33*c* is provided in one to one correspondence to the nozzle $\mathbf{33}_d$. As illustrated in FIGS. 2 and 3, the nozzle 33*d* is overlapped with the pressure chamber 33*c* in the vertical direction at a center of the pressure chamber 33*c* in the widthwise direction and the conveying direction.

A plurality of sets of the nozzle 33*d* and the pressure chamber 33*c* are arrayed one after another in the widthwise direction as illustrated in FIG. 2 to form a row or column of the plurality of sets, and four columns R1-R4 are arrayed in the conveying direction. Each of the actuators 40 is provided for each of the four columns R1-R4.

The nozzles 33*d* belonging to the first column R1 positioned most upstream in the conveying direction among the four columns are for the black ink ejection. The nozzles 33*d* belonging to the second column R2 positioned beside the first column R1 in the conveying direction are for the yellow ink ejection. The nozzles 33*d* belonging to the third column R3 positioned beside the second column R2 in the conveying direction are for the cyan ink ejection. The nozzles 33*d* belonging to the fourth column R4 positioned beside the third column R3 in the conveying direction are for the magenta ink ejection.

As illustrated in FIG. 3, a vibrating film 26 is positioned on an upper surface of the plate 24. The vibrating film 26 covers the plurality of pressure chambers 33*c*. As illustrated in FIG. 2, a through-hole constituting an inflow channel 33*b* is formed in the vibrating film 26 at a position overlapping in the vertical direction with a downstream end portion in the conveying direction of each of the pressure chambers 33*c* belonging to the columns R1 and R2. A through-hole constituting the inflow channel 33*b* is formed in the vibrating film 26 at a position overlapping in the vertical direction with an upstream end portion in the conveying direction of each of the pressure chambers 33*c* belonging to the columns R3 and R4.

Further, a through-hole constituting an inflow channel 33*e* is formed in the vibrating film 26 at a position overlapping in the vertical direction with an upstream end portion in the conveying direction of each of the pressure chambers 33*c* belonging to the columns R1 and R2. A through-hole constituting the outflow channel 33*e* is formed in the vibrating film 26 at a position overlapping in the vertical direction with a downstream end portion in the conveying direction of each of the pressure chambers 33*c* belonging to the columns R3 and R4. The vibrating film 26 is formed by oxidation of the upper surface of the plate 24, and is made from silicon dioxide ($SiO_2$).

As illustrated in FIG. 3, the plate 23 is positioned on an upper surface of the vibrating film 26. The plate 23 is formed with a through-hole constituting an inflow channel 33*a* at a position in alignment with each of the inflow channels 33*c* in the vertical direction. The plate 23 is formed with another through-hole constituting an outflow channel 33*f* at a position in alignment with each of the outflow channels 33*e* in the vertical direction. The plate 23 has a lower surface formed with four recessed portions 23*x*. Each of the actuators 40 is positioned in each of the recessed portions 23X. Each actuator 40 is accommodated in a space defined by each recessed portion 23X and the vibrating film 26.

Each of the actuators 40 includes a common electrode 42 positioned on the upper surface of the vibrating film 26, a piezoelectric body 41 positioned on an upper surface of the common electrode 42, and a plurality of discrete electrodes 43 positioned on an upper surface of the piezoelectric body 41. The piezoelectric body 41 and the common electrode 42 extend in the widthwise direction over the plurality of pressure chambers 33*c* belonging to respective columns R1-R4. The discrete electrode 43 is provided for each pressure chamber 33*c* and is overlapped therewith in the vertical direction.

The common electrode 42 and the plurality of discrete electrodes 43 are electrically connected to a driver IC (not illustrated). The driver IC is controlled by the controller 5 to vary voltage of the discrete electrode 43 and to maintain voltage of the common electrode 43 to a ground voltage. Specifically, the driver IC is configured to generate drive signal in response to control signal transmitted from the controller 5, and to apply the drive signal to the discrete electrode 43.

Thus, voltage changes between predetermined voltage and the ground voltage. In this instance, a part of the vibrating film 26 facing the pressure chamber 33*c* and a part of the piezoelectric body 41 facing the discrete electrode 43 are deformed into convex shape toward the pressure chamber 33*c* to change volume of the pressure chamber 33*c*. This change in volume applies pressure to the ink stored in the pressure chamber 33*c*, thereby ejecting ink through the nozzle 33*d*.

A plurality of discrete channels 33 are formed in the plates 23-25 and the vibrating film 26. Each discrete passage 33 is constituted by the inflow channels 33*a*, 33*b*, the pressure chamber 33*c*, the nozzle 33*d*, and the outflow channels 33*e*, 33*f*. The discrete passage 33 is symmetrical in shape with respect to a vertical line passing through the nozzle 33*d* between halves of the discrete passage 33 in the conveying direction.

The plate unit 22 is positioned on an upper surface of the plate 23. The plate unit 22 is formed with four common supply channels 31*b* and four common return channel 32*b*. As illustrated in FIG. 2, a set of the common supply channel 31*b* and the common return channel 32*b* is provided for each of the four columns R1 through R4, and the plurality of sets are arrayed in the conveying direction.

A layout of the common supply channel 31*b* and the common return channel 32*b* in the columns R1 and R2 is opposite to the layout in the columns R3 and R4. Specifically, in the columns R1 and R2, the common supply channel 31*b* is positioned downstream of the common return channel 32*b* in the conveying direction, whereas in the column R3 and R4, the common supply channel 31*b* is positioned upstream of the common return channel 32*b* in the conveying direction.

Each common supply channel 31*b* extends in the widthwise direction and is overlapped with the plurality of the inflow channels 33*a* in the vertical direction of each of the columns R1-R4. Further, each common return channel 32*b* extends in the widthwise direction and is overlapped with the plurality of the outflow channels 33*f* in the vertical direction of each of the columns R1-R4.

As illustrated in FIG. 3, the plate 21 is positioned on an upper surface of the plate unit 22. The plate 21 is formed with a supply hole 31*x* at a position overlapping in the vertical direction with one end portion in the widthwise direction of each common supply channel 31*b*. The plate 21 is also formed with a return hole 32*x* at a position overlapping in the vertical direction with an end portion in the widthwise direction of each common return channel 32*b*. The end portion of the common return channel 32*b* is positioned opposite to the one end portion of the common supply channel 31*b* in the widthwise direction.

A sub-tank 7 is provided for each of the columns R1-R4. The sub-tank 7 defines therein a storage chamber 7*a*. A supply passage 31 is provided for fluidly connecting the storage chamber 7*a* to the supply hole 31*x*, and a return passage 32 is provided for fluidly connecting the storage chamber 7*a* to the return hole 32*x*. Therefore, the plurality of discrete channels 33, the supply passage 31, and the return passage 32 for each of the columns R1-R4 are in communication with the storage chamber 7*a* through the supply hole 31*x* and the return hole 32*x*.

Four sub-tanks 7 (not illustrated that four sub-tanks are provided) are provided for four columns R1-R4 for storing inks of different colors. One of the sub-tanks 7 (one of the storage chamber 7*a*) for the color of black is provided for the first column R1. A second sub-tank (7) (one of the storage chamber (7*a*)) for the color of yellow is provided for the second column R2. A third sub-tank (7) (one of the storage chamber (7*a*)) for the color of yellow is provided for the third column R3. A fourth sub-tank (7) (one of the storage chamber (7*a*)) for the color of magenta is provided for the fourth column R4.

The printer further includes a four main tanks (not illustrated) storing inks of black, yellow, cyan, and magenta, respectively. For the column R1, the main tank of black ink is in communication with the sub-tank 7 of black ink, so that black ink supplied from the main tank can be stored in the storage chamber 7*a* of the sub-tank 7. For the column R2, the second main tank of yellow ink is in communication with the second sub-tank of yellow ink, so that yellow ink supplied from the second main tank can be stored in the second storage chamber of the second sub-tank. For the column R3, the third main tank of cyan ink is in communication with the third sub-tank of cyan ink, so that cyan ink supplied from the third main tank can be stored in the third storage chamber of the third sub-tank. For the column R4, the fourth main tank of magenta ink is in communication with the fourth sub-tank of magenta ink, so that magenta ink supplied from the fourth main tank can be stored in the fourth storage chamber of the fourth sub-tank.

A relationship between the sub-tank 7 and the plurality of discrete passages 33 with respect to each of the columns R1-R4 will be described. The storage chamber 7*a* has an exit port 7*ay*, and each of the plurality of discrete channels 33 has an inlet opening 33*x* as illustrated in FIG. 3. The inlet por 33*x* is an inlet end or an upper end of the inflow channel 33*a*. The supply passage 31 includes a passage 31*a* and the common supply channel 31 *b*. The passage 31*a* has one end connected to the exit port 7*ay* and another end connected to the supply hole 31*x*. A pump P is provided at the passage 31*a*.

The storage chamber 7*a* has an inlet port lax, and each of the plurality of discrete channels 33 has an outlet opening 33*y* as illustrated in FIG. 3. The outlet opening 33*y* is an outlet end or an upper end of the outflow channel 33*f*. The return passage 32 includes a passage 32*a* and the common return channel 32*b*. The passage 32*a* has one end connected to the inlet port 7*ax* and another end connected to the return hole 32*x*. The passages 31*a* and the 32*a* are provided by tubular members.

Ink circulation occurs by the actuation of the pump P under the control by the controller 5. That is, ink flows out of the storage chamber 7*a* through the exit port 7*ay* into the supply passage 31, each of the discrete passages 33, and the return passages 32, and is returned into the storage chamber 7*a* through the inlet port 7*ax*. During this circulation, the ink discharged through the exit port 7*ay* is introduced into the common supply channel 31*b* through the passage 31*a*, and reaches each discrete passage 33 through each inlet opening 33*x*.

The ink introduced into each discrete channel 33 passes through the inflow channels 33*a* and 33*b* and is introduced into the pressure chamber 33*c*. A part of the ink is ejected outside through the nozzle 33*d*, and remaining ink passes through the outflow channels 33*e*, 33*f*, and flows out of the outlet opening 33*y*. The ink flows out of each discrete channel 33 through the outlet opening 33*y* is introduced into the common return channel 32*b*, and then the passage 32*a*, and is returned into the storage chamber 7*a* through the inlet port 7*ax*. Such recirculation of the ink discharges air bubble retained in each discrete passage 33, and prevents the ink from being viscous. Further, in a case where the ink contains precipitation component such as pigment, such settling component can be agitated to avoid precipitation.

Figure 4:
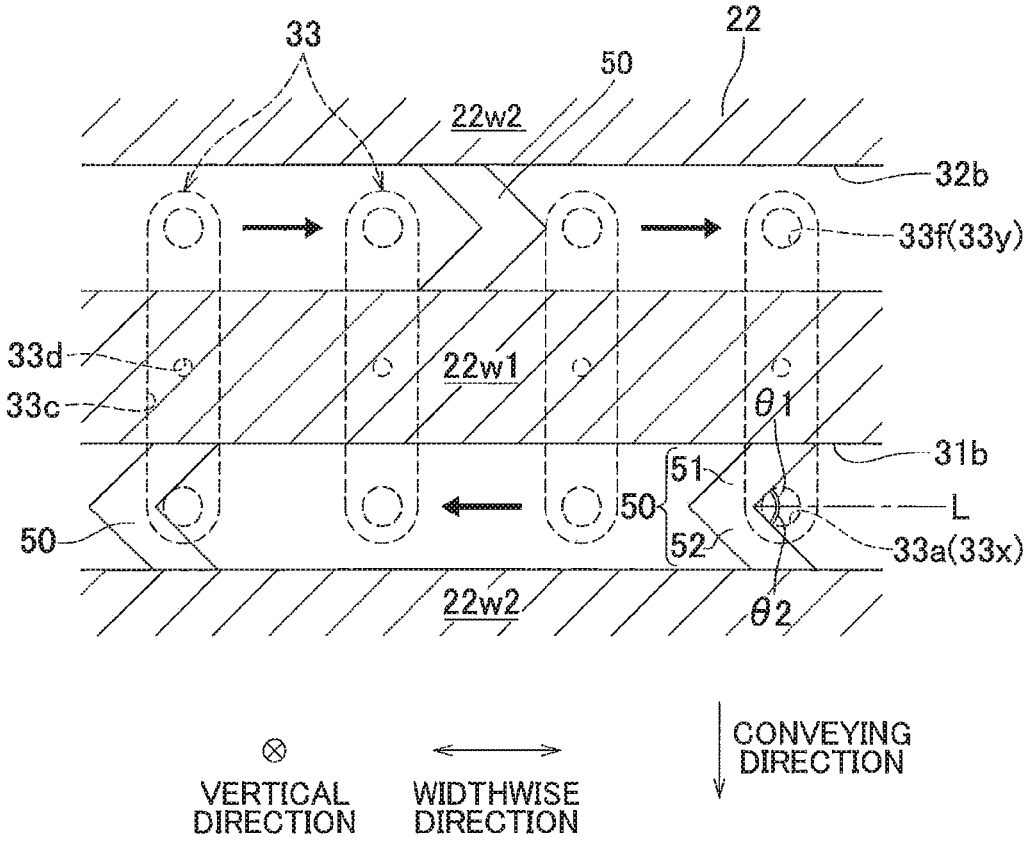
FIG. 4 is a cross-sectional view of a plate unit 22 located in a region IV in FIG. 2 of the head 1 and taken along a plane perpendicular to a vertical direction.

Each common channel 31*b*, 32*b* is provided with a plurality of protruding pieces 50. As illustrated in FIG. 4, each protruding piece 50 is V-shaped as viewed in the vertical direction. The plate unit 22 includes two walls 22*w*1 and 22*w*2 defining the common channels 31*b*, 32*b* therebetween and facing with each other in the conveying direction. Each protruding piece 50 protrudes from the walls 22*w*1, 22*w*2 and connects the walls together.

Each protruding piece 50 includes a first sloped portion 51 protruding from the wall 22*w*1, and a second sloped portion 52 protruding from the wall 22*w*2. Each of the sloped portions 51, 52 extends in a flowing direction of the ink flowing through the common channels 31*b*, 32*b* as indicated by arrows in FIG. 4, such that an apex of the protruding piece 50 is positioned at a downstream end of the protruding piece 50 in the flowing direction. The flowing direction extends parallel to the widthwise direction, and flowing direction in the common supply channel 31*b* is opposite to that in the common return channel 32*b*. Here, "the flowing direction" implies a component of the flowing direction.

The first sloped portion 51 extends in the flowing direction and in a direction crossing the widthwise direction and the conveying direction from the wall 22*w*1 to a center in the conveying direction of the common channel 31, 32*b*. The second sloped portion 52 extends in the flowing direction and in the direction crossing the widthwise direction and the conveying direction from the wall 22*w*2 to the center in the conveying direction of the common channel 31, 32*b*.

As illustrated in FIG. 4, an angle θ1 is defined between the first sloped portion 51 and a line segment L, and an angle θ2 is defined between the second sloped portion 52 and the line segment L. The line segment L extends in the widthwise diction and directs toward an upstream side in the flowing direction. The line segment L is positioned at the center in the conveying direction of the common channel 31*b*, 32*b*, the center being a connecting portion between the first and second sloped portions 51 and 52. These angles θ1 and θ2 are in a range of from 30° to 60°. According to the depicted embodiment, the angle θ1 is 45°, and equal to the angle θ2. The connecting portion is positioned at a downstream end portion of the protruding piece 50 in the flowing direction.

Dimension of each protruding piece 50 is determined in order to lower pressure loss in the common channel 31*b*, 32*b*, that is, in order to provide smooth ink flow which is not interrupted by the protruding piece 50. That is, each protruding piece 50 has a width (width of the sloped portions 51, 52) is smaller than a width (length in the conveying direction) of the common channel 31*b*, 32*b*. Further, each protruding piece 50 has a thickness (length in the vertical direction) smaller than the length in the vertical direction of the common channel 31*b*, 32*b*. On the other hand, if the width or thickness is too small, a rigidity of the protruding piece 50 cannot be secured. Therefore, in the present embodiment, each protruding piece 50 has the width ranging from 0.3 to 0.5 mm, and the thickness ranging from 0.05 to 0.1 mm, so as to provide both smooth ink flow and sufficient rigidity.

In the common supply channel 31*b*, the inlet opening 33*x* of the discrete passage 33 is positioned at a downstream end portion of the sloped portions 51, 52 in the flowing direction. Specifically, the inlet opening 33*x* is positioned immediate upstream of the connecting portion between the sloped portions 51 and 52 in the flowing direction.

Figure 5:
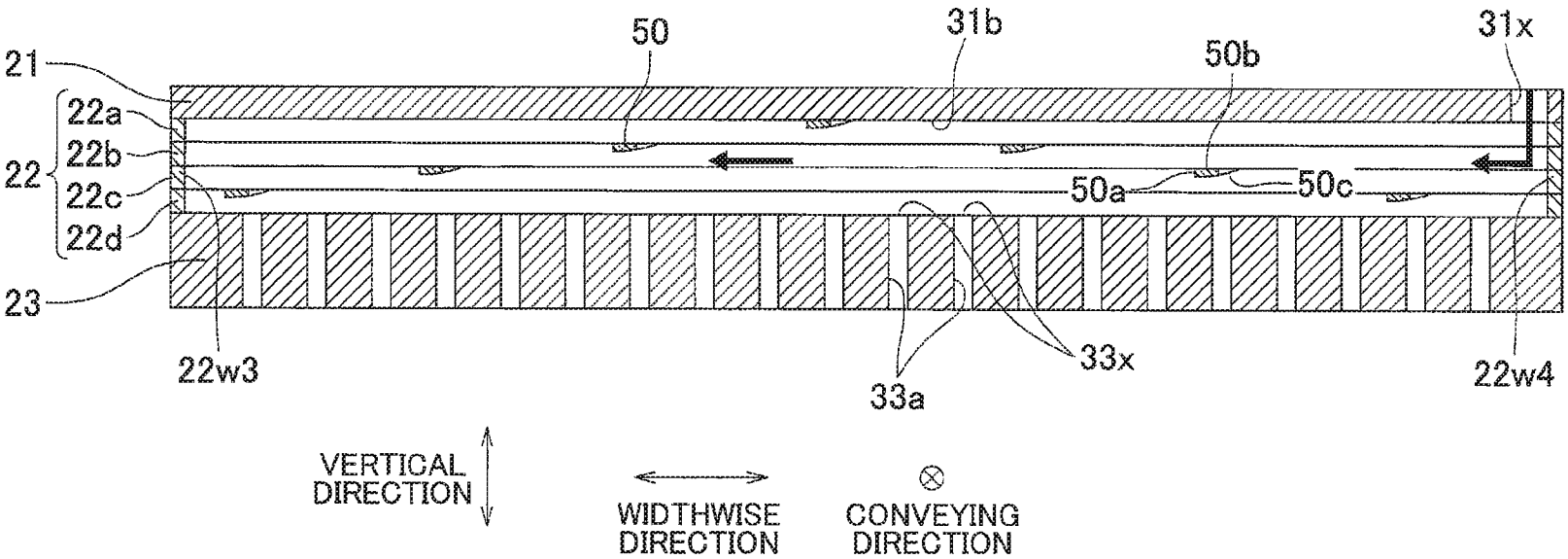
FIG. 5 is a cross-sectional view of a portion adjacent to the plate unit 22 and taken along a line V-V in FIG. 2.
Figure 6:
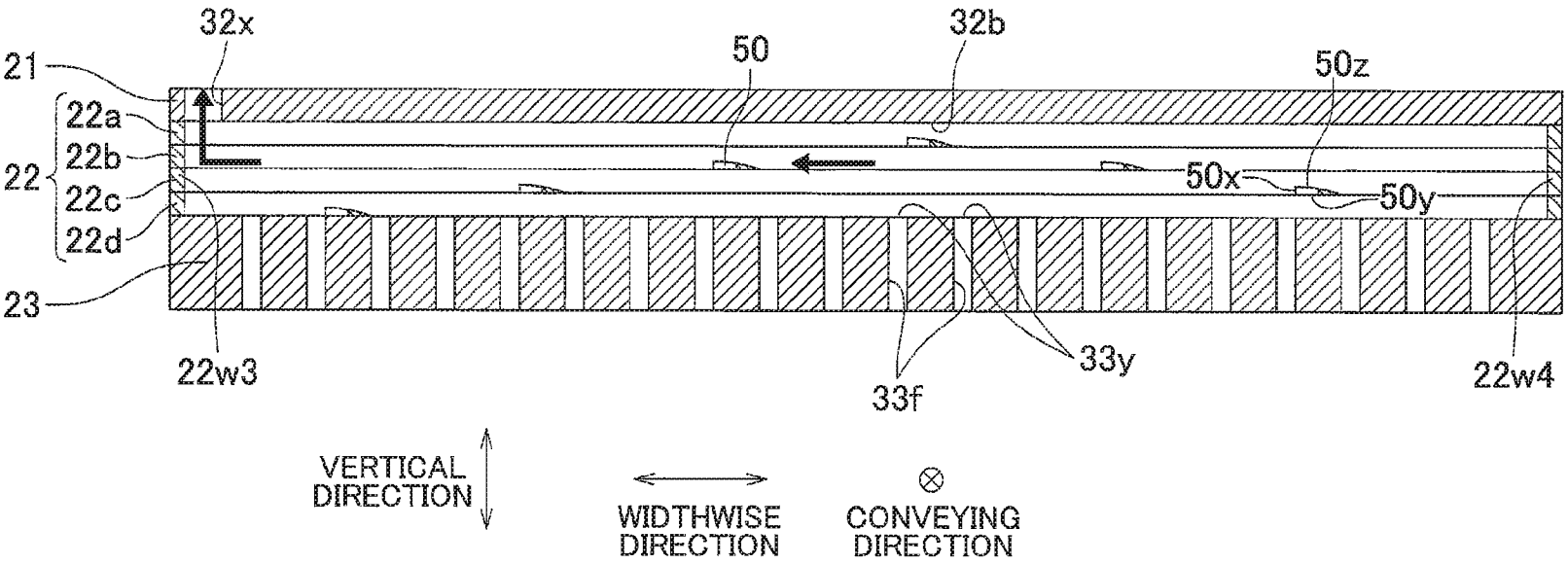
FIG. 6 is a cross-sectional view of a portion adjacent to the plate unit 22 and taken along a line VI-VI in FIG. 2.

As illustrated in FIGS. 3, 5 and 6, the plate unit 22 is constituted by four plates 22*a*-22*d* laminated in the vertical direction and adhered one after another and made from SUS or silicon. The common channel 31*b*, 32*b* is provided throughout the four plates 22*a*-22*d*. On the other hand, each protruding piece 50 is positioned on each of the four plates 22*a*-22*d*. As illustrated in FIGS. 5 and 6, vertical positions of the protruding pieces 50 neighboring in the widthwise direction are different from each other.

As illustrated in FIG. 3, the supply hole 31*x* and the return hole 32*x* are positioned above the common channel 31*b*, 32*b*. In the common supply channel 31*b*, the protruding piece 50 positioned closest in the widthwise direction to the supply hole 31*x* (the rightmost protruding piece 50 among seven protruding pieces 50 in FIG. 5) is formed at the lowermost plate 22*d* among the four plates 22*a*-22*d*. Further, in the common return channel 32*b*, the protruding piece 50 positioned closest in the widthwise direction to the return hole 32*x* (the leftmost protruding piece 50 among six protruding pieces 50 in FIG. 6) is formed at the lowermost plate 22*d*.

Each protruding piece 50 is formed in each of the plates 22*a*-22*d* by half etching process. As illustrated in FIGS. 5 and 6, in a cross-section taken along a plane perpendicular to the conveying direction, a thickness of each protruding piece 50 is gradually increased in the flowing direction.

As illustrated in FIG. 5, the protruding piece 50 provided in the common supply channel 31*b* has a cross-sectional shape defined by a vertical line 50*a*, a horizontal line 50*b*, and a curved line 50*c*. The horizontal line 50*b* extends in the widthwise direction and toward upstream in the flowing direction from an upper end of the vertical line 50*a*. The curved line 50*c* has one end connected to a lower end of the vertical line 50*a* and another end connected to an upstream end of the horizontal line 50*b*. The curved line 50*c* smoothly curved in the flowing direction and is bulged downward.

As illustrated in FIG. 6, the protruding piece 50 provided in the common return channel 32*b* has a cross-sectional shape defined by a vertical line 50*x*, a horizontal line 50*y*, and a curved line 50*z*. The horizontal line 50*y* extends in the widthwise direction and toward upstream in the flowing direction from a lower end of the vertical line 50*x*. The curved line 50*z* has one end connected to an upper end of the vertical line 50*x* and another end connected to an upstream end of the horizontal line 50*y*. The curved line 50*z* is smoothly curved in the flowing direction and is bulged upward.

As illustrated in FIGS. 5 and 6, the plate unit 22 also includes end walls 22*w*3, and 22*w*4 facing with each other in the widthwise direction and defining the common channel 31*b*, 32*b*. Here, the center portion in the widthwise direction of the common channel 31*b*, 32*b* is remote from the end walls 22*w*3, 22*w*4, and therefore, the center portion has a rigidity lower than that of the remaining portion. According to the present embodiment, since protruding pieces 50 are positioned at the center portion, rigidity at the center portion can be compensated.

Further, as illustrated in FIG. 2, the protruding piece 50 in the common supply channel 31*b* and the protruding piece 50 in the common return channel 32*b* positioned adjacent to the common supply channel 31*b* are different from each other in the conveying direction.

According to the present embodiment, the head 1 has the common channels 31*b* and 32*b*, and the protruding piece 50 protrudes from at least one of the walls 22*w*1 and 22*w*2 (FIG. 4). The protruding piece 50 strengthen the rigidity of the walls 22*w*1, 22*w*2 avoiding deformation and crack of the walls.

The protruding piece 50 protrudes from the two walls 22*w*1, 22*w*2 connecting the two walls together (FIG. 4). Thus, enhanced rigidity of the walls 22*w*1, 22*w*2 can be obtained avoiding deformation and crack of the walls with high reliability.

The protruding piece 50 includes the extending portion (sloped portions 51 and 52) extending in the ink flowing direction (FIG. 4). If the protruding piece extends in a direction perpendicular to the flowing direction such as conveying direction and the vertical direction, flow of ink may be impeded by the protruding piece. According to the above-described embodiment, smooth ink flow can be obtained by the extending portion. Therefore, problem of impediment of ink flow due to the protruding piece does not occur.

In the common supply channel 31*b*, the inlet opening 33*x* of the discrete channel 33 is positioned at a downstream end portion of the extending portion (sloped portions 51, 52). Therefore, the ink smoothly moving along the extending portion can be smoothly introduced into the inlet opening 33*x* of the discrete passage 33.

The protruding piece 50 includes the first sloped portion 51 protruding from the wall 22*w*1 and the second sloped portion 52 protruding from the wall 22*w*2 (FIG. 4). Generally, flow velocity of the ink in the common channel 31*b*, 32*b* becomes highest at a center in the conveying direction of the common channel 31*b*, 32*b*. According to the above-described embodiment, the ink flows along respective pairs of sloped portions 51,52 toward the center, higher flow velocity can be obtained, further avoiding problem of impediment of ink flow due to the protruding pieces.

The angle θ1 defined between the first sloped portion 51 and the line segment L extending in the widthwise diction, and the angle θ2 defined between the second sloped portion 52 and the line segment L are in the range of from 30° to 60° (FIG. 4). In other words, an angle defined by the first sloped portion 51 and the second sloped portion is in a range of from 60° to 120°. If the angles θ1 and θ2 are less than 30°, the sloped portions 51 52 may provide reduced rigidity against external force directing in the conveying direction. Thereby reducing reinforcement to the walls 22*w*1, 22*w*2. On the other hand, if the angles θ1 and θ2 are more than 60°, increase in velocity of the ink flowing in the common channel 31*b*, 32*b* toward the center in the conveying direction of the common channel may not be obtained with such sloped portions, and accordingly, intended effect of restraining impediment of ink flow by the protruding piece may be lowered.

The plurality of protruding pieces 50 are at positions different from one another in the vertical direction (FIGS. 5 and 6). Stagnation of air bubbles and pressure loss increase may occur if the plurality of protruding pieces are at even position in the vertical direction. The present embodiment can avoid such drawbacks.

In each of the common channels 31*b*, 32*b*, two protruding pieces 50 neighboring in the widthwise direction are at positions different from each other in the vertical direction (FIGS. 5 and 6). In this case, stagnation of air bubbles and pressure loss increase in each common channel can be restrained.

The supply hole 31*x* and the return hole 32*x* are positioned above the common channel 31*b*, 32*b*. Further, one of the protruding pieces 50 positioned closest in the widthwise direction to the supply hole 31*x* among the plurality of protruding pieces 50 in the common supply channel 31*b* (for example, the rightmost protruding piece in FIG. 5) and one of the protruding pieces 50 positioned closest in the widthwise direction to the return hole 32*x* among the plurality of protruding pieces 50 in the common return channel 32*b* (for example, the leftmost protruding piece in FIG. 6) are positioned lower than the remaining protruding pieces 50.

Since the protruding piece 50 closest in the widthwise direction to the supply hole 31*x* and the protruding piece 50 closest in the widthwise direction to the return hole 32*y* are positioned apart from the supply hole 31*x* and the return hole 32*y*, respectively, in the vertical direction, the closest protruding piece does not become an obstacle for the ink flowing between the storage chamber 7*a* and the common channel 31*b*, 32*b*. That is, the ink flowing from the supply hole 31*x* to the common supply channel 31*b*, and the ink flowing from the common return channel 32*b* to the return hole 32*x* flow smoothly.

The common channel 31*b*, 32*b* is formed by the combination of the four plates 22*a* to 22*d*, whereas each protruding piece 50 is formed at each of the four plates (FIGS. 5 and 6). In this case, the plurality of protruding pieces 50 can be easily formed at positions different from one another in the vertical direction.

Each protruding piece 50 is formed at each plate by half etching. In this case, reduction of thickness of the protruding piece can be performed easily. Therefore, the problem of impeding the flow of ink by a thick protruding piece can be avoided.

The protruding piece 50 in the common supply channel 31*b* is at the position different in the widthwise direction from the position of the protruding piece 50 in the common return channel 32*b* adjacent to the common supply channel 31*b* in the conveying direction (FIG. 2).

If the position of the protruding piece 50 in the common supply channel 31*b* is the same as the position of the protruding piece 50 in the common return channel 32*b* in the widthwise direction, occurrence of pressure loss is concentrated at a certain position in the widthwise direction in the common channel, so that ejection of ink at the certain position may be turbulent, which degrades imaging quality. According to the present embodiment, occurrence of pressure loss can be dispersed in the widthwise direction, avoiding degradation of imaging quality.

In the cross-section of the protruding piece 50 taken along the plane perpendicular to the conveying direction, the thickness of the protruding piece 50 is gradually increased in the flowing direction (FIGS. 5 and 6). This shape allows the ink to smoothly flow along the surface of the protruding piece 50, which effectively provides smooth flowing of the ink, and the problem of impediment of ink flow due to the protruding piece can be effectively restrained.

The ink descends toward the common supply channel 31*b* from the supply hole 31*x*. As illustrated in FIG. 5, the protruding piece 50 provided in the common supply channel 31*b* has a cross-sectional shape defined by the vertical line 50*a*, the horizontal line 50*b* extending in the widthwise direction and toward upstream in the flowing direction from the upper end of the vertical line 50*a*, and the curved line 50*c* having the one end connected to the lower end of the vertical line 50*a* and the other end connected to the upstream end of the horizontal line 50*b*. The curved line 50*c* is smoothly curved in the flowing direction and is bulged downward. With this structure, the ink flowing into the common supply channel 31*b* from the supply hole 31*x* can be smoothly introduced downward, and the problem of impediment of ink flow due to the protruding piece can be effectively restrained.

The ink ascends from the common return channel 32*b* to the return hole 32*x*. As illustrated in FIG. 6, the protruding piece 50 provided in the common return channel 32*b* has the cross-sectional shape defined by the vertical line 50*x*, the horizontal line 50*y* extending in the widthwise direction and toward upstream in the flowing direction from the lower end of the vertical line 50*x*, and a curved line 50*z* having the one end connected to the upper end of the vertical line 50*x* and the other end connected to the upstream end of the horizontal line 50*y*. The curved line 50*z* is smoothly curved in the flowing direction and is bulged upward. With this structure, the ink flowing from the common return channel 32*b* to the return hole 32*x* can be smoothly introduced upward, and the problem of impediment of ink flow due to the protruding piece can be effectively restrained.

Second Embodiment

Figure 7:
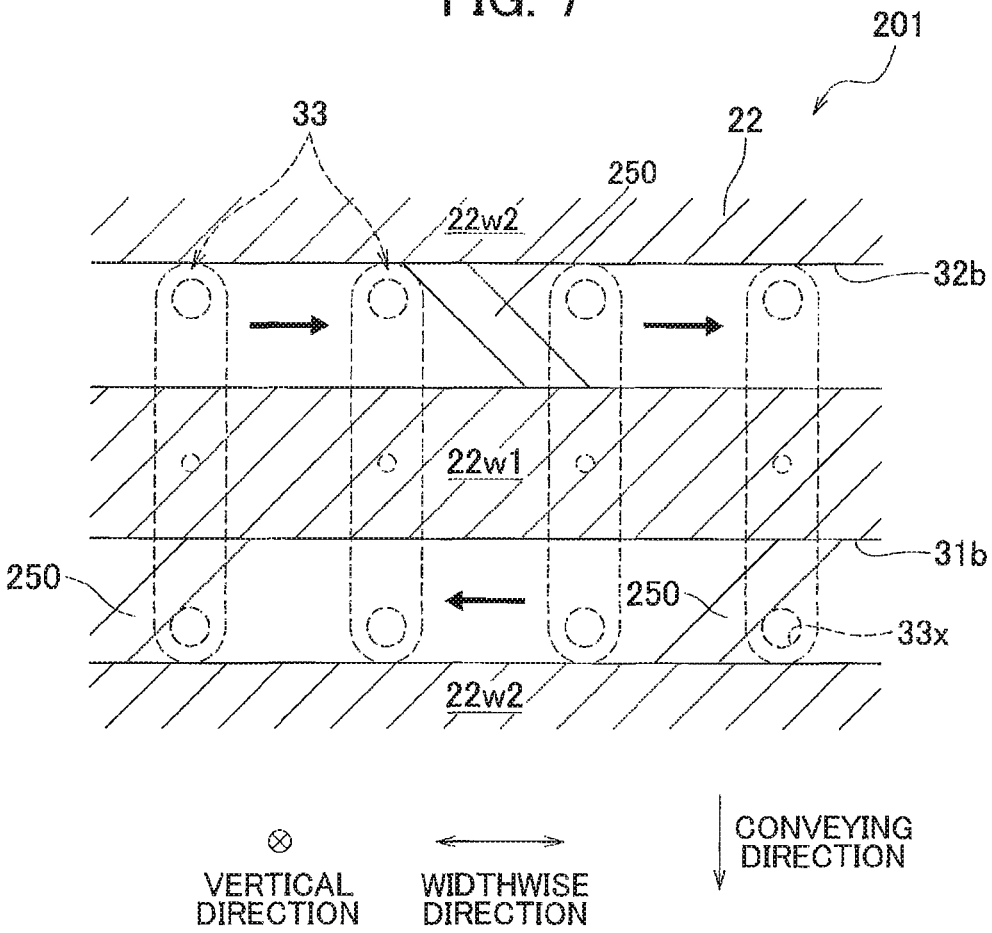
FIG. 7 is a cross-sectional view corresponding to FIG. 4 in a head 201 according to a second embodiment.

A head 201 according to a second embodiment will next be described with reference to FIG. 7. The second embodiment is the same as the first embodiment except the protruding pieces. In the second embodiment, each of protruding pieces 250 is not V-shaped but is linear in shape as viewed in the vertical direction. Specifically, the protruding piece 250 extends linearly from the wall 22*w*1 to the wall 22*w*2 those defining the common channels 31*b*, 32*b* and facing with each other in the conveying direction. Extending direction of the protruding piece 250 crosses the widthwise direction and the conveying direction.

Similar to the first embodiment, each protruding piece 250 protrudes from the walls 22*w*1 and 22*w*2 connecting the walls 22*w*1 and 22*w*2 together, and generally extends in the flowing direction. The inlet opening 33*x* is positioned adjacent to a downstream end portion in the flowing direction of each protruding piece 250 in the common supply channel 31*b*. Specifically, the inlet opening 33*x* is positioned immediate upstream in the flowing direction of the downstream end portion of the protruding piece 250.

With this structure, similar to the first embodiment, the ink in the common supply channel 31*b* can smoothly flow into the inlet opening 33*x* of the discrete passage 33 along the extending portion (protruding piece 250). In the second embodiment, the protruding piece 250 has a simple structure in shape. Thus, formation of the protruding piece 250 can be facilitated.

Third Embodiment

Figure 8:
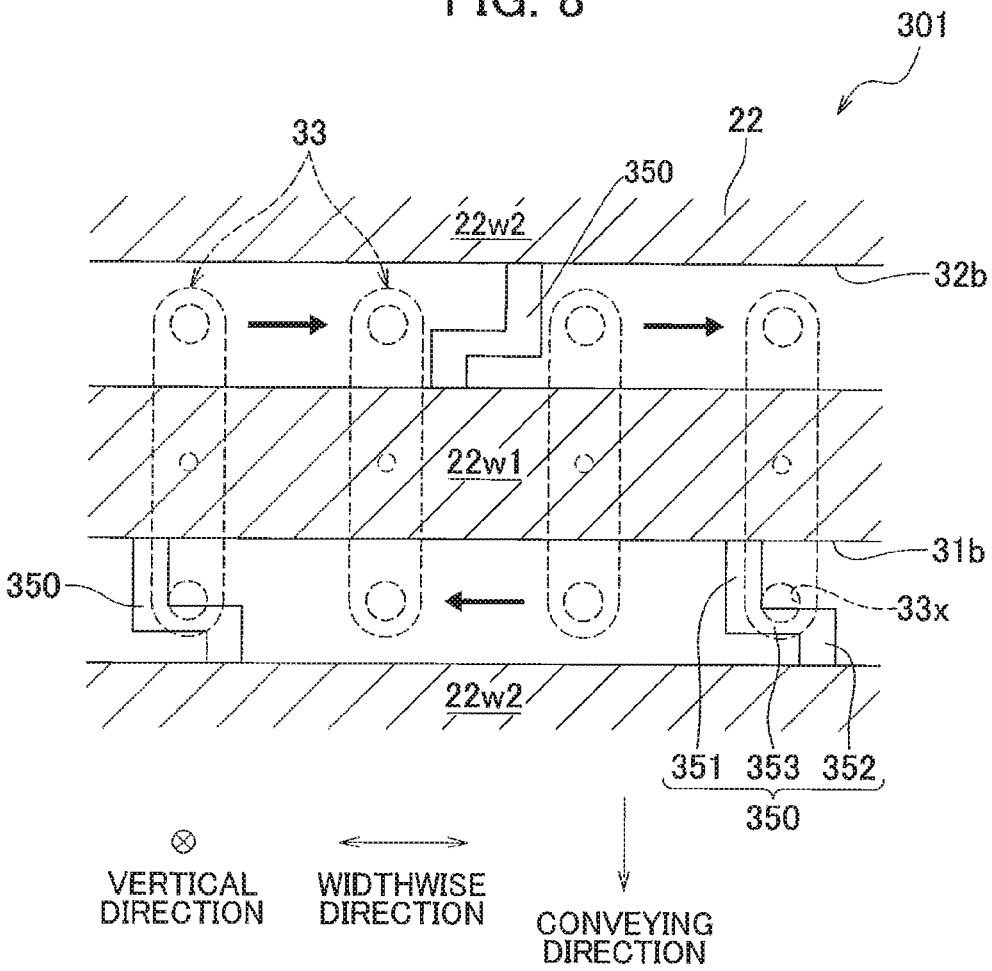
FIG. 8 is a cross-sectional view corresponding to FIG. 4 in a head 301 according to a third embodiment.

A head 301 according to a third embodiment will next be described with reference to FIG. 8. The third embodiment is the same as the first embodiment except the protruding pieces. In the third embodiment, each protruding piece 350 is crank shaped including a first portion 351, a second portion 352, and a third portion 353. The first portion 351 extends from the wall 22*w*1 in the conveying direction, and the second portion 352 extends from the wall 22*w*2 in the conveying direction, the walls 22*w*1 and 22*w*2 facing with each other in the conveying direction and defining the common channel 31*b*, 32*b* therebetween. The third portion 353 extends in the widthwise direction and has one end connected to the first portion 351 and another end connected to the second portion 352.

Similar to the protruding piece 50 in the first embodiment, the protruding piece 350 protrudes from the walls 22*w*1 and 22*w*2 to connect the walls together. Further, the protruding piece 50 includes a portion (third portion 353) extending in the flowing direction. Further, in the common supply channel 31*b*, the inlet opening 33*x* of the discrete passage 33 is positioned adjacent to a downstream end portion in the flowing direction of each protruding piece 350. Specifically, the inlet opening 33*x* is positioned immediate upstream in the flowing direction of the connecting portion between the first portion 351 and the third portion 353.

In the third embodiment, the protruding piece 350 has a simple structure in shape. Thus, formation of the protruding piece 350 can be facilitated.

Fourth Embodiment

Figure 9:
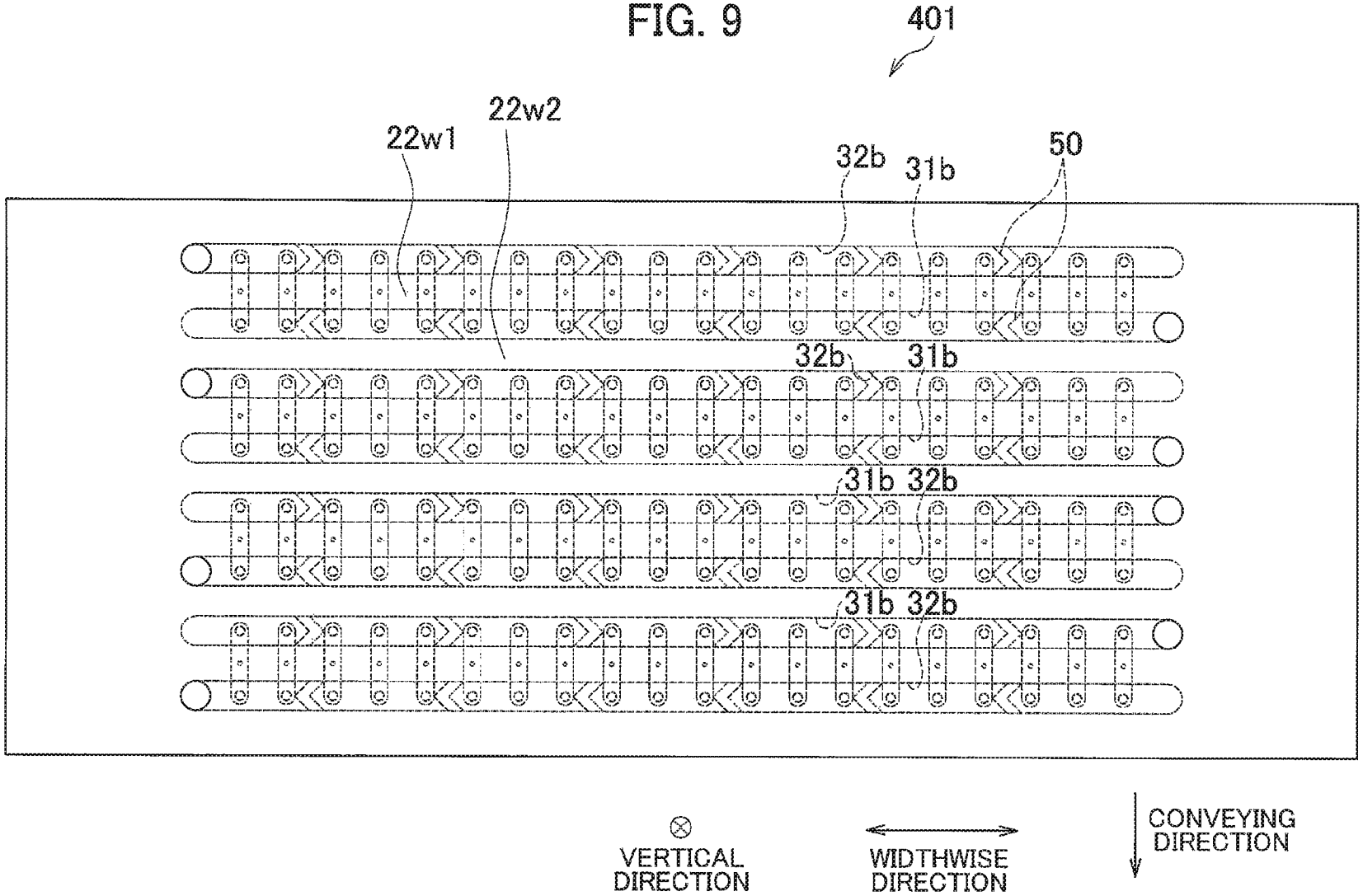
FIG. 9 is a plan view of a head 401 corresponding to FIG. 2 according to a fourth embodiment.

A head 401 according to a fourth embodiment will next be described with reference to FIG. 9. The third embodiment is the same as the first embodiment except for the positions of the protruding pieces 50 in the widthwise direction. Specifically, in the first embodiment as illustrated in FIG. 2, the position of the protruding piece 50 in the common supply channel 31*b* is different, in the widthwise direction, from the position of the protruding piece 50 in the common return channel 32*b* positioned adjacent to the common supply channel 31*b* in the conveying direction. On the other hand, in the fourth embodiment, as illustrated in FIG. 9, the position of the protruding piece 50 in the common supply channel 31*b* is the same, in the widthwise direction, as the position of the protruding piece 50 in the common return channel 32*b* positioned adjacent to the common supply channel 31*b* in the conveying direction.

According to the fourth embodiment, the portions of the walls 22*w*1 and 22*w*2 from which the protruding piece 50 protrudes can provide increased rigidity because of the in-line arrangement of the protruding pieces 50 in the conveying direction. Thus, deformation and generation of crack in the portions of the walls can be restrained.

Modifications

Various modifications are conceivable. For example, the angle θ1 defined by the first sloped portion 51 and the line segment L and the angle θ2 defined by the second sloped portion 52 and the line segment L may be less than 30°, or greater than 60°, or the angle θ1 and the angle θ2 may be different from each other as long as the angle θ1+θ2 is in a range of from 60° to 120°.

In the common supply channel, the inlet hole 33*x* for one of the plurality of discrete passages 33 may not be formed at the position adjacent to the downstream end portion of the extending portion 50 as illustrated in FIG. 9.

Figure 10:
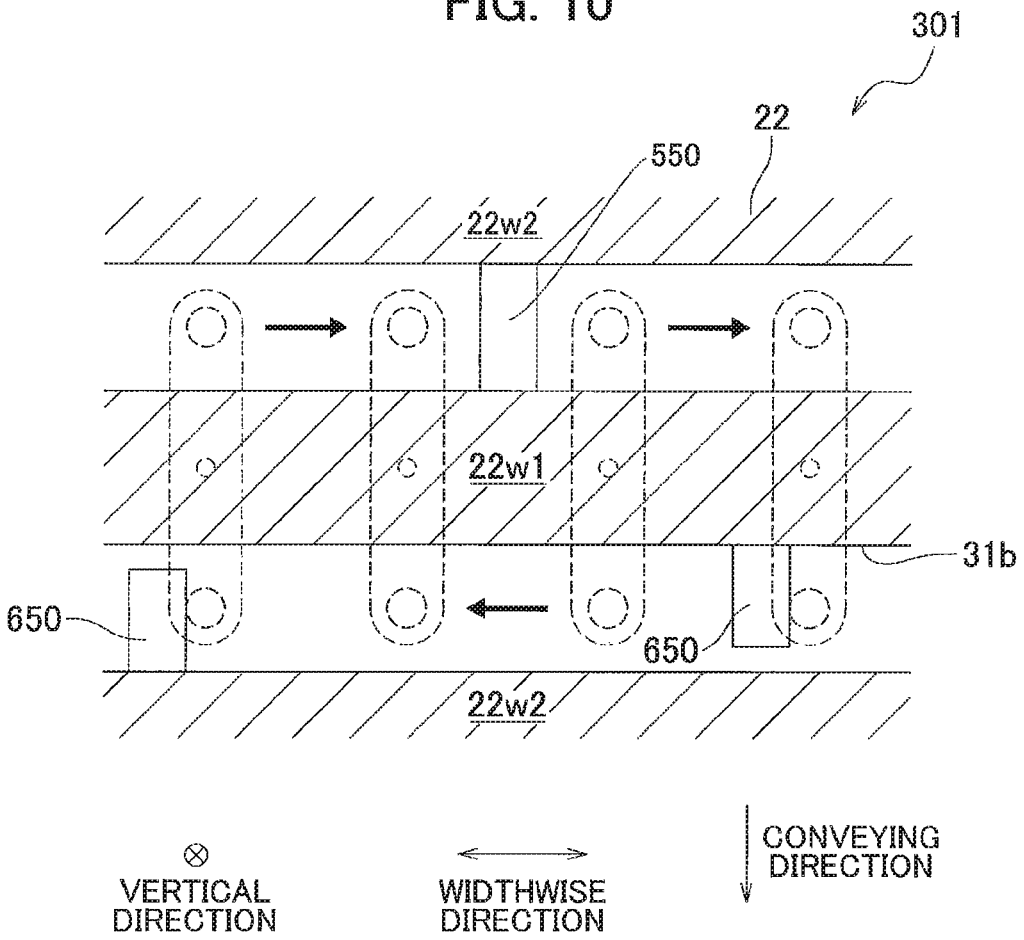
FIG. 10 is a cross-sectional view corresponding to FIG. 4 in a head having a protruding piece according to a modification.

The extending portion of the protruding piece may not extend in the flowing direction. For example, in a modification illustrated in FIG. 10, a protruding piece 550 extends in the conveying direction perpendicular to the flowing direction.

The protruding piece may not span between the walls 22*w*1 and 22*w*2 defining the common channel and facing with each other in the conveying direction. For example, in the modification illustrated in FIG. 10, a protruding piece 650 protrudes from the wall 22*w*1, and its free end does not reach the other wall 22*w*2 but is positioned adjacent to the other wall 22*w*2, whereas another protruding piece 650 protrudes from the other wall 22*w*2, and its free end does not reaches the one wall 22*w*1 but is positioned adjacent to the wall 22*w*1. With this structure, when the walls are deformed, the free ends of the protruding pieces 650 are brought into contact with the adjacent walls to restrain further deformation of the walls.

The protruding piece positioned closest in the widthwise direction to the supply hole 31*x* or to the return hole 32*x* in the common supply channel 31*b* or the common return channel 32*b* may be positioned close to the supply hole 31*x* or the return hole 32*x* in the vertical direction.

Further, the supply hole 31*x* and the return hole 32*x* may not be formed above the plate unit 22, i.e., above the common supply channel 31*b* and the common return channel 32*b*, but may be formed in the plate unit 22. For example, the supply hole 31*x* and the return hole 32*x* may open at an inner peripheral surface (defining the common supply channel 31*b* or the common return channel 32*b*) of the plate unit 22.

Protruding pieces neighboring in the widthwise direction in the common channel 31*b* or 32*b* may be at the even vertical position. For example, all protruding pieces may be at the even vertical position in one common channel, and all protruding pieces may be at the even vertical position in another common channel, but the vertical position of the protruding pieces in the other common channel is different from that in the one common channel. Alternatively, all protruding pieces may be at the even vertical position in all common channels.

In a common channel, each of the plurality of protruding pieces may not be formed at each of the plates 22*a*-22*d* of the plate unit 22, but the plurality of protruding pieces may be formed exclusively in a specific one of the plates.

Each protruding piece may not be formed by half etching, i.e., may not be integral with the wall 22*w*1 and/or 22*w*2. For example, each protruding piece is a member different from the walls defining the common channel Each protruding piece may be fixed to the wall(s) by an adhesive agent.

A cross-sectional shape of the protruding piece taken along the plane perpendicular to the widthwise direction and the conveying direction may not be limited to the shape illustrated in FIGS. 5 and 6. For example, a triangular or rectangular cross section constituted by linear lines excluding the curved line is available.

Numbers of the common supply channel and the common return channel for one head is non-limiting. A plurality of common supply channels and the common return channels are provided for one head, or a single common supply channel and a single common return channel may be provided for one head.

Positions of the supply hole 31*x* and the return hole 32*x* is non-limiting. In the above-described embodiment, the supply hole 31*x* is positioned at one end portion in the widthwise direction of the common supply channel 31*b*, and the return hole 32*x* is positioned at the other end portion in the widthwise direction of the common return channel 32*b*.

However, the supply hole 31*x* may be positioned at one end portion in the widthwise direction of the common supply channel 31*b*, and the return hole 32*x* is positioned at the one end portion in the widthwise direction of the common return channel 32*b*. In the latter case, flowing direction of the ink flowing through the common supply channel 31*b* and the common return channel 32*b* positioned adjacent thereto in the conveying direction is the same.

Two or more supply holes 31*x* may be formed for one common supply channel 31*b*. In this case, among the plurality of the common discrete passages 33 in communication with the one common supply channel 31*b*, a higher liquid pressure is applied to a particular common discrete passage 33 closer to the supply hole 31*x* than the remaining common discrete passages are to the supply hole 31*x*. However, pressure variation can be restrained in comparison with a case where the liquid is supplied into the one common supply channel from one supply hole.

Two or more return holes 32*x* may be formed for one common return channel 32*b*. In this case, among the plurality of the common discrete passages 33 in communication with the one common return channel 32*b*, a higher liquid pressure is applied to a particular common discrete passage 33 farther from the return hole 32*x* than the remaining common discrete passages are from the return hole 32*x*. However, pressure variation can be restrained in comparison with a case where the liquid is discharged from the one common supply channel from one return hole.

Numbers of nozzles 33*d* in each discrete passage 33 or numbers of pressure chambers 33*c* are non-limiting. For example, each discreate channel 33 may includes one nozzle and two pressure chambers. Alternatively, each discrete channel 33 may include not less than two nozzles.

A piezoelectric system employing piezoelectric element but also is available as the actuator. However, other types such as a thermal system employing a heat generating element and an electrostatic system using electrostatic force are also available.

A line system is available as a head. However, also available is a serial system where liquid ejection is performed during movement of a head in a scanning direction parallel to the widthwise direction of the sheet.

An article subjected to liquid ejection is not only a sheet of a paper, but also a cloth and a circuit board.

A liquid to be ejected from the nozzle is not limited to the ink, but also available is other liquid such as process liquid for aggregating or precipitating a component contained in the ink, and liquefied metal and resin.

The liquid ejection head according to the present disclosure is applied to a printer, but the head is also applicable to other image forming device such as a facsimile machine, a copying machine, and a multi-function peripheral. The heat is further applicable to a liquid ejection device other than the image forming device such as a device for ejecting electrically conductive liquid to a board to form an electrically conductive pattern on the board.

While the description has been made in detail with reference to the embodiments thereof, it would be apparent to those skilled in the art that many modifications and variations may be made therein without departing from the spirit of the disclosure.

<Remarks>

The head 1, 201, 301 and 401 are example of "liquid ejection head". The widthwise direction of the sheet 9 is an example of "first direction", the conveying direction is an example of "second direction", and the vertical direction is an example of "third direction". The supply hole 31*x* and the return hole 32*x* are example of "communicating portion with a storage chamber in the common passage". The angle θ1 and the angle θ2 are example of "first angle" and "second angle" respectively. The vertical lines 50*a*, 50*x* are example of "first linear line", and the horizontal lines 50*b*, 50*y* are examples of "second linear line". The first sloped portion 51, the second sloped portion 52, the protruding piece 250 and the third portion 353 are example of "extending portion".

What is claimed is:

1. A liquid ejection head fluidly connected to a storage chamber storing therein a liquid, the storage chamber having an outlet port and an inlet port, the liquid ejection head comprising:

a plurality of discrete passages each having a nozzle, an inlet opening and an outlet opening;

a common channel in communication with the plurality of discrete passages, the common channel being defined by two walls extending in a first direction and facing each other in a second direction perpendicular to the first direction, the common channel comprising:

a common supply channel fluidly connected to the outlet port and to the inlet opening to introduce the liquid in the storage chamber to the plurality of discrete passages through the common supply channel; and a common return channel fluidly connected to the outlet opening and to the inlet port to return the liquid in the plurality of discrete passages to the storage chamber, the common supply channel and the common return channel being positioned side by side in the second direction; and a protruding piece provided in each of the common supply channel and the common return channel and protruding from each of the walls to connect the walls together.

2. The liquid ejection head according to claim 1, wherein the protruding piece includes an extending portion extending in a flowing direction of the liquid flowing through the common channel, the flowing direction being parallel to the first direction.

3. The liquid ejection head according to claim 2, wherein the extending portion has a downstream end portion in the flowing direction; and wherein the inlet opening is positioned adjacent to the downstream end portion.

4. The liquid ejection head according to claim 2, wherein the protruding piece comprises:

a first sloped portion extending from one of the walls to a center in the second direction of the common channel in a direction crossing the first direction and the second direction toward a downstream side in the flowing direction; and a second sloped portion extending from remaining one of the walls to the center of the common channel in a direction crossing the first direction and the second direction toward the downstream side, the second sloped portion being connected to the first sloped portion at the center providing a connecting portion.

5. The liquid ejection head according to claim 4, wherein the first sloped portion and a line segment extending from the connecting portion in the first direction and toward a downstream side in the flowing direction define a first angle therebetween, and the second sloped portion and the line segment define a second angle therebetween, the first angle and the second angle being in a range of from 30° to 60°.

6. The liquid ejection head according to claim 2, wherein the extending portion extends from one of the walls to a remaining one of the walls in a direction crossing the first direction and the second direction toward a downstream side in the flowing direction.

7. The liquid ejection head according to claim 1, wherein the protruding piece comprises:

an extending portion extending in the first direction and having one end and another end in the first direction;

a first portion protruding from one of the walls in the second direction and connected to the one end of the extending portion; and a second portion protruding from remaining one of the walls in the second direction and connected to the other end of the extending portion.

8. The liquid ejection head according to claim 1, wherein the protruding piece comprises a plurality of protruding pieces, positions of the protruding pieces being different from one another in a third direction perpendicular to the first direction and the second direction, the third direction being a height direction.

9. The liquid ejection head according to claim 8, wherein the protruding pieces neighboring in the first direction and positioned in an identical common channel are at positions different from each other in the third direction.

10. The liquid ejection head according to claim 9, wherein the common channel has one end and another end in the third direction, and has a communicating portion in communication with the storage chamber;

wherein the communicating portion is positioned closer to the one end than to the other end; and wherein the plurality of protruding pieces comprises a first protruding piece and a second protruding piece positioned farther from the communicating portion than the first protruding piece is from the communicating portion in the first direction, the first protruding piece being positioned closer to the other end than the second protruding piece is to the another other end.

11. The liquid ejection head according to claim 1, wherein the walls comprise a plurality of plates laminated one after another in a third direction;

wherein the common channel extends through the plurality of plates; and wherein each of the protruding piece is provided at each of the plurality of plates.

12. The liquid ejection head according to claim 11, wherein each of the protruding pieces is formed in each of the plurality of plates by half etching.

13. The liquid ejection head according to claim 1, wherein the protruding piece positioned in the common supply channel and the protruding piece positioned in the common return channel are at positions different from each other in the first direction.

14. The liquid ejection head according to claim 1, wherein the protruding piece positioned in the common supply channel and the protruding piece positioned in the common return channel are at even position in the first direction.

15. The liquid ejection head according to claim 1, wherein the liquid flows in the common channel in a flowing direction parallel to the first direction; and wherein the protruding piece has a cross-sectional shape taken along a plane perpendicular to the second direction such that a length of the cross-sectional shape in a third direction perpendicular to the first direction and the second direction is gradually increased toward a downstream side in the flowing direction, the third direction being a height direction.

16. The liquid ejection head according to claim 15, wherein the common supply channel has one end and another end in the third direction, and has a communicating portion in communication with the storage chamber;

wherein the communicating portion is positioned closer to the one end than to the other end;

wherein the cross-sectional shape is defined by a first linear line extending in the third direction the first linear line having one end and another end in the third direction;

a second linear line extending from the one end of the first linear line in the first direction toward an upstream side in the flowing direction, the second linear line having an upstream end in the flowing direction; and a curved line extending from the other end of the first linear line to the upstream end of the second linear line, the curved line bulging toward the other end in the third direction of the common channel.

17. The liquid ejection head according to claim 15, wherein the common return channel has one end and another end in the third direction, and has a communicating portion in communication with the storage chamber;

wherein the communicating portion is positioned closer to the one end than to the other end;

wherein the cross-sectional shape is defined by a first linear line extending in the third direction, the first linear line having one end and another end in the third direction;

a second linear line extending from the one end of the first linear line in the first direction toward an upstream side in the flowing direction, the second linear line having an upstream end in the flowing direction; and a curved line extending from the other end of the first linear line to the upstream end of the second linear line, the curved line bulging toward the one end in the third direction of the common channel.

* * * * *